US005804542A

United States Patent [19]

Scheper et al.

[11] Patent Number: 5,804,542

[45] **Date of Patent: *Sep. 8, 1998**

[54] AUTOMATIC DISHWASHING COMPOSITIONS COMPRISING COBALT CATALYSTS

[75] Inventors: William Michael Scheper, Lawrenceburg, Ind.; Alan Scott Goldstein, Blue Ash; Edward Eugene Getty, Cincinnati, both of Ohio

[73] Assignee: The Procter & Gamble Company, Cincinnati, Ohio

[ * ] Notice: The term of this patent shall not extend beyond the expiration date of Pat. No. 5,599,781.

[21] Appl. No.: 799,594

[22] Filed: Feb. 10, 1997

Related U.S. Application Data

[63] Continuation of Ser. No. 382,742, Feb. 2, 1995.

[51] Int. Cl.[6] ..... C11D 1/66; C11D 3/26; C11D 3/39; C11D 3/395

[52] U.S. Cl. ..... 510/221; 510/224; 510/227; 510/228; 510/375; 510/376; 134/25.2

[58] Field of Search ..... 510/221, 224, 510/227, 228, 375, 376; 134/25.2

[56] References Cited

U.S. PATENT DOCUMENTS

| | | | |
|---|---|---|---|
| 4,810,410 | 3/1989 | Diakun et al. | 252/102 |
| 4,915,854 | 4/1990 | Mao et al. | 252/8.8 |
| 5,089,162 | 2/1992 | Rapisarda et al. | 252/102 |
| 5,173,207 | 12/1992 | Drapier et al. | 252/99 |
| 5,240,633 | 8/1993 | Ahmed et al. | 252/99 |
| 5,518,648 | 5/1996 | Welch et al. | 252/174.22 |
| 5,527,484 | 6/1996 | Ahmed et al. | 252/95 |
| 5,534,180 | 7/1996 | Miracle et al. | 510/220 |
| 5,589,099 | 12/1996 | Baum | 510/514 |
| 5,599,781 | 2/1997 | Haeggberg et al. | 510/220 |

FOREIGN PATENT DOCUMENTS

| | | |
|---|---|---|
| 272030 | 6/1988 | European Pat. Off. . |
| 408131 | 1/1991 | European Pat. Off. . |
| 2054019 | 10/1971 | Germany . |

*Primary Examiner*—Paul Lieberman
*Assistant Examiner*—Gregory R. Del Cotto
*Attorney, Agent, or Firm*—Ian S. Robinson; Brian M. Bolam; Kim William Zerby

[57] ABSTRACT

Automatic dishwashing detergent compositions comprising certain cobalt catalysts are provided. More specifically, the invention relates to automatic dishwashing detergents which provide enhanced cleaning/bleaching benefits (especially tea stain removal) through the selection of cobalt catalysts having the formula:

$$[Co(NH_3)_n(X)_m]\Gamma_y.$$

Preferred automatic dishwashing compositions comprise amylase and/or protease enzymes. Included are methods for washing tableware in domestic automatic dishwashing appliances using the cobalt catalysts.

14 Claims, No Drawings

AUTOMATIC DISHWASHING COMPOSITIONS COMPRISING COBALT CATALYSTS

This is a continuation of application Ser. No. 08/382,742, filed on Feb. 2, 1995.

TECHNICAL FIELD

The present invention is in the field of automatic dishwashing detergents comprising bleach. More specifically, the invention encompasses automatic dishwashing detergents (liquids, pastes, and solids such as tablets and especially granules) comprising selected cobalt/ammonia catalysts. Preferred methods for washing tableware are included.

BACKGROUND OF THE INVENTION

Automatic dishwashing, particularly in domestic appliances, is an art very different from fabric laundering. Domestic fabric laundering is normally done in purpose-built machines having a tumbling action. These are very different from spray-action domestic automatic dishwashing appliances. The spray action in the latter tends to cause foam. Foam can easily overflow the low sills of domestic dishwashers and slow down the spray action, which in turn reduces the cleaning action. Thus in the distinct field of domestic machine dishwashing, the use of common foam-producing laundry detergent surfactants is normally restricted. These aspects are but a brief illustration of the unique formulation constraints in the domestic dishwashing field.

Automatic dishwashing with bleaching chemicals is different from fabric bleaching. In automatic dishwashing, use of bleaching chemicals involves promotion of soil removal from dishes, though soil bleaching may also occur. Additionally, soil antiredeposition and anti-spotting effects from bleaching chemicals would be desirable. Some bleaching chemicals, (such as a hydrogen peroxide source, alone or together with tetraacetylethylenediamine, TAED) can, in certain circumstances, be helpful for cleaning dishware, but this technology gives far from satisfactory results in a dishwashing context: for example, ability to remove tough tea stains is limited, especially in hard water, and requires rather large amounts of bleach. Other bleach activators developed for laundry use can even give negative effects, such as creating unsightly deposits, when put into an automatic dishwashing product, especially when they have overly low solubility. Other bleach systems can damage items unique to dishwashing, such as silverware, aluminium cookware or certain plastics.

Consumer glasses, dishware and flatware, especially decorative pieces, as washed in domestic automatic dishwashing appliances, are often susceptible to damage and can be expensive to replace. Typically, consumers dislike having to separate finer pieces and would prefer the convenience and simplicity of being able to combine all their tableware and cooking utensils into a single, automatic washing operation. Yet doing this as a matter of routine has not yet been achieved.

On account of the foregoing technical constraints as well as consumer needs and demands, automatic dishwashing detergent (ADD) compositions are undergoing continual change and improvement. Moreover environmental factors such as the restriction of phosphate, the desirability of providing ever-better cleaning results with less product, providing less thermal energy, and less water to assist the washing process, have all driven the need for improved ADD compositions.

A recognized need in ADD compositions is to have present one or more ingredients which improve the removal of hot beverage stains (e.g., tea, coffee, cocoa, etc.) from consumer articles. Strong alkalis like sodium hydroxide, bleaches such as hypochlorite, builders such as phosphates and the like can help in varying degrees but all can also be damaging to, or leave a film upon, glasses, dishware or silverware. Accordingly, milder ADD compositions have been developed. These make use of a source of hydrogen peroxide, optionally with a bleach activator such as TAED, as noted. Further, enzymes such as commercial amylolytic enzymes (e.g., TERMAMYL® available from Novo Nordisk S/A) can be added. The alpha-amylase component provides at least some benefit in the starchy soil removal properties of the ADD. ADD's containing amylases typically can deliver a somewhat more moderate wash pH in use and can remove starchy soils while avoiding delivering large weight equivalents of sodium hydroxide on a per-gram-of-product basis. It would therefore be highly desirable to secure improved bleach activators specifically designed to be compatible in ADD formulations, especially with enzymes such as amylases. A need likewise exists to secure better amylase action in the presence of bleach activators.

Certain manganese catalyst-containing machine dishwashing compositions are described in U.S. Pat. No. 5,246,612, issued Sep. 21, 1993, to Van Dijk et al. The compositions are said to be chlorine bleach-free machine dishwashing compositions comprising amylase and a manganese catalyst (in the +3 or +4 oxidation state), as defined by the structure given therein. Preferred manganese catalyst therein is a dinuclear manganese, macrocyclic ligand-containing molecule said to be $Mn^{IV}_2(u\text{-}O)_3$(1,4,7-trimethyl-1,4,7-triazacyclononane)$_2(PF_6)_2$. Such catalyst materials which contain these more complicated ligands typically will require several synthesis steps to produce, thereby driving up the cost of the catalysts and making them less likely to be readily available for use. Thus, there continues to be a need for simple, widely available catalysts that are effective in automatic dishwashing compositions and methods.

The simple cobalt catalysts useful herein have been described for use in bleach-containing laundry compositions to wash stained fabrics as taught by U.S. Pat. No. 4,810,410, to Diakun et al, issued Mar. 7, 1989. For example, Table 8 therein provides the stain removal results for a series of stains on fabrics washed with laundry compositions with and without the cobalt catalyst $[Co(NH_3)_5Cl]Cl_2$. Tea stain removal from fabrics as reported therein appears marginal at best by comparison to the other stains measured.

The comparative inferiority of the cobalt catalysts herein for laundry applications to remove tea stains is reinforced by the teachings contained in the later filed European Patent Application, Publication No. 408,131, published Jan. 16, 1991 by Unilever NV. Example IV therein, said to be a comparison of the cobalt—cobolt complexes which are viewed as the invention of that application versus the "$[Co(NH_3)_5Cl]Cl_2$ of the art" (referring to the earlier publication of the European equivalent of the above-noted Diakun et al patent), reports values for removal of tea stain as follows: Co-Co (26.3); $[Co(NH_3)_5Cl]Cl_2$ (20.6), which is lower than that observed for a simple Mn+2 catalyst as reported in Example II (having a tea stain removal value of 21.4).

Similar results for manganese catalysts versus cobalt catalysts are reported for laundry uses to remove tea stains from cotton fabrics in U.S. Pat. No. 5,244,594, to Favre et al., issued Sep. 14, 1993. Therein, Example I provides data slowing a Co-Co catalyst according to EP 408,131 is inferior to the manganese catalysts. Further, Example IV also reports lower stain removal at 20° C. for a Co-Co catalyst of EP 408,131 and the $[Co(NH_3)_5Cl]Cl_2$ catalyst of the Diakun patent versus a manganese catalyst.

While such inferior results are seen for removal of tea stain from fabrics during laundry processes, when used in automatic dishwashing compositions according to the present invention, these catalysts provide surprisingly effective tea stain removal from dishes. Such effectiveness would not have been expected from the prior art.

It is an object of the instant invention to provide automatic dishwashing compositions, especially compact granular, phosphate-free types, incorporating an improved selection of cobalt catalyst-containing bleaching ingredients. A further object is to provide fully-formulated ADD compositions with or without amylase enzymes, but especially the former, wherein specific cobalt catalyst-containing bleach systems are combined with additional selected ingredients including conventional amylases or bleach-stable amylases, so as to deliver superior tea cleaning results and at the same time excellent care for consumer tableware and flatware.

BACKGROUND ART

In addition to the hereinbefore-noted U.S. Pat. No. 4,810,410, to Diakun et al, issued Mar. 7, 1989; U.S. Pat. No. 5,246,612, to Van Dijk et al., issued Sep. 21, 1993; U.S. Pat. No. 5,244,594, to Favre et al., issued Sep. 14, 1993; and European Patent Application, Publication No. 408,131, published Jan. 16, 1991 by Unilever NV, see also: U.S. Pat. No. 5,114,611, to Van Kralingen et al, issued May 19, 1992 (transition metal complex of a transition metal, such as cobalt, and a non-macro-cylcic ligand); U.S. Pat. No. 4,430,243, to Bragg, issued Feb. 7,1984 (laundry bleaching compositions comprising catalytic heavy metal cations, including cobalt); German Patent Specification 2,054,019, published Oct. 7, 1971 by Unilever N.V. (cobalt chelant catalyst); and European Patent Application Publication No. 549,271, published Jun. 30, 1993 by Unilever PLC (macrocyclic organic ligands in cleaning compositions).

SUMMARY OF THE INVENTION

It has now been discovered that a specific group of $NH_3$ coordinated, cobalt-containing catalysts provide unexpected, superior automatic dishwashing detergent ("ADD") cleaning performance. Such performance is illustrated by, but not limited to, tea stain removal.

Taken broadly, the present invention encompasses automatic dishwashing detergents comprising:

(a) a catalytically effective amount of a cobalt catalyst having the formula:

$$[Co(NH_3)_n(X)_m]T_y$$

wherein cobalt is in the +3 oxidation state; n is an interger from 3 to 5 (preferably 4 or 5; most preferably 5); X is one or more labile coordinating moieties, preferably selected from the group consisting of chlorine, bromine, hydroxide, water, and (when m is greater than 1) combinations thereof, m is an integer from 1 to 3 (preferably 1 or 2; most preferably 1); m+n=6; and T is one or more appropriately selected counteranions present in a number y, where y is an integer from 0 to 3 (preferably 1 to 3; most preferably 2 when T is a −1 charged anion), to obtain a charge-balanced salt, preferred T are selected from the group consisting of chloride, nitrate, nitrite, sulfate, citrate, acetate, carbonate, and combinations thereof;

(b) an effective amount of a source of hydrogen peroxide; and (c) automatic dishwashing detergent adjunct materials.

The preferred automatic dishwashing detergent compositions herein further comprise an amylase enzyme. Whereas conventional amylases such as TERMAMYL® may be used with excellent results, preferred ADD compositions can use oxidative stability-enhanced amylases. Such an amylase is available from NOVO. In it, oxidative stability is enhanced from substitution using threonine of the methionine residue located in position 197 of *B.Licheniformis* or the homologous position variation of a similar parent amylase.

The instant ADD's have numerous advantages, for example they are economical, compact, less damaging to consumer tableware than might be expected on the basis of their potent bleaching action, they are not reliant on chlorinated compounds, and they may be formulated to avoid the undesirable use of overly high levels of caustic ingredients. In certain preferred embodiments, they are substantially free of boron and/or phosphate.

In the ADD composition embodiments, additional bleach-improving materials can be present. Preferably, these are selected from bleach activator materials, such as tetraacetylethylenediamine ("TAED").

The present invention encompasses granular-form, fully-formulated ADD's, preferably phosphate builder-free and chlorine bleach-free, in which additional ingredients, including other enzymes (especially proteases and/or amylases) are formulated.

The instant invention also encompasses methods; more particularly, a method of washing tableware in a domestic automatic dishwashing appliance, comprising treating the soiled tableware in an automatic dishwasher with an aqueous alkaline bath comprising a cobalt-containing catalyst having the formula as provided hereinbefore and a source of hydrogen peroxide.

The present invention also relates to automatic dishwashing rinse aid compositions comprising a cobalt-containing catalyst as described herein, and methods for treating tableware in a domestic automatic dishwashing appliance during a rinse cycle with these cobalt-containing catalysts.

As already noted, the invention has advantages, including the excellent combination of tea stain removal, good dishcare, and good overall cleaning aided by a greater flexibility to formulate enzymes, especially amylases.

All parts, percentages and ratios used herein are expressed as percent weight unless otherwise specified. All documents cited are, in relevant part, incorporated herein by reference.

DETAILED DESCRIPTION OF THE INVENTION

Automatic Dishwashing Compositions:

Automatic dishwashing compositions of the present invention preferably comprise a source of hydrogen peroxide and a particularly selected cobalt catalyst. The source of hydrogen peroxide is any common hydrogen-peroxide releasing salt, such as sodium perborate or sodium percarbonate. In the preferred embodiments, additional ingredients such as water-soluble silicates (useful to provide alkalinity and assist in controlling corrosion), low-foaming nonionic surfactants (especially useful in automatic dishwashing to control spotting/filming), dispersant polymers (which modify and inhibit crystal growth of calcium and/or magnesium salts), chelants (which control transition metals), builders such as citrate (which help control calcium and/or magnesium and may assist buffering action), alkalis (to adjust pH), and detersive enzymes (to assist with tough food cleaning, especially of starchy and proteinaceous soils), are present. Additional bleach-modifying materials such as conventional bleach activators such as TAED may be added, provided that any such bleach-modifying materials are delivered in such a manner as to be compatible with the purposes of the present invention. The present detergent compositions may, moreover, comprise one or more processing aids, fillers, perfumes, conventional enzyme particle-making materials including enzyme cores or "nonpareils", as well as pigments, and the like.

In general, materials used for the production of ADD compositions herein are preferably checked for compatibility with spotting/filming on glassware. Test methods for spotting/filming are generally described in the automatic dishwashing detergent literature, including DIN test methods. Certain oily materials, especially at longer chain lengths, and insoluble materials such as clays, as well as long-chain fatty acids or soaps which form soap scum are therefore preferably limited or excluded from the instant compositions.

Amounts of the essential ingredients can vary within wide ranges, however preferred automatic dishwashing detergent compositions herein (which have a 1% aqueous solution pH of from about 7 to about 12, more preferably from about 9 to about 12, and most preferably less than about 11, especially from about 9 to about 11) are those wherein there is present: from about 0.1% to about 70%, preferably from about 0.5% to about 30% of a source of hydrogen peroxide; from about 0.01% to about 2%, preferably from about 0.05% to about 0.6% of the cobalt catalyst; from about 0.1% to about 40%, preferably from about 0.1% to about 20% of a water-soluble silicate; and from about 0.1% to about 20%, preferably from about 0.1% to about 10% of a low-foaming nonionic surfactant. Such fully-formulated embodiments typically further comprise from about 0.1% to about 15% of a polymeric dispersant, from about 0.01% to about 10% of a chelant, and from about 0.00001% to about 10% of a detersive enzyme though further additional or adjunct ingredients may be present. Detergent compositions herein in granular form typically limit water content, for example to less than about 7% free water, for best storage stability.

Further, preferred ADD compositions of this invention are substantially free of chlorine bleach. By "substantially free" of chlorine bleach is meant that the formulator does not deliberately add a chlorine-containing bleach additive, such as a chloroisocyanurate, to the preferred ADD composition. However, it is recognized that because of factors outside the control of the formulator, such as chlorination of the water supply, some non-zero amount of chlorine bleach may be present in the wash liquor. The term "substantially free" can be similarly constructed with reference to preferred limitation of other ingredients, such as phosphate builder.

By "effective amount" herein is meant an amount which is sufficient, under whatever comparative test conditions are employed, to enhance cleaning of a soiled surface. Likewise, the term "catalytically effective amount" refers to an amount of cobalt catalyst which is sufficient under whatever comparative test conditions are employed, to enhance cleaning of the soiled surface. In automatic dishwashing, the soiled surface may be, for example, a porcelain cup with tea stain, dishes soiled with simple starches or more complex food soils, or a plastic spatula stained with tomato soup. The test conditions will vary, depending on the type of washing appliance used and the habits of the user. Some machines have considerably longer wash cycles than others. Some users elect to use warm water without a great deal of heating inside the appliance; others use warm or even cold water fill, followed by a warm-up through a built-in electrical coil. Of course, the performance of bleaches and enzymes will be affected by such considerations, and the levels used in fully-formulated detergent and cleaning compositions can be appropriately adjusted.

Cobalt Catalysts:

The present invention compositions and methods utilize cobalt (III) catalysts having the formula:

$$[CO(NH_3)_n(X)_m]T_y$$

wherein cobalt is in the +3 oxidation state; n is an interger from 3 to 5 (preferably 4 or 5; most preferably 5), X is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and T is an appropriately selected counteranion present in a number y, which is an integer from 0 to 3 (preferably 1 to 3; most preferably 2 when T is a −1 charged anion), to obtain a charge-balanced salt, preferred T are selected from the group consisting of chloride, nitrate, nitrite, sulfate, citrate, acetate, carbonate, and combinations thereof The most preferred cobalt catalyst useful herein has the formula $[Co(NH_3)_5Cl]Ty.$, and especially $[Co(NH_3)_5Cl]Cl_2$.

These cobalt catalysts are readily prepared by known procedures, such as taught for example in U.S. Pat. No. 4,810,410, to Diakun et al, issued Mar. 7, 1989, and *J. Chem. Ed.* (1989), 66 (12), 1043–45; The Synthesis and Characterization of Inorganic Compounds, W. L. Jolly (Prentice-Hall; 1970), pp. 461–3.

These cobalt catalysts may be coprocessed with adjunct materials so as to reduce the color impact if desired for the aesthetics of the product, or the composition may be manufactured to contain catalyst "speckles".

As a practical matter, and not by way of limitation, the ADD compositions and processes herein can be adjusted to provide on the order of at least one part per ten million of the active cobalt catalyst species in the aqueous washing medium, and will preferably provide from about 0.1 ppm to about 50 ppm, more preferably from about 1 ppm to about 25 ppm, and most preferably from about 2 ppm to about 10 ppm, of the cobalt catalyst species in the wash liquor. In order to obtain such levels in the wash liquor, typical ADD compositions herein will comprise from about 0.04% to about 1%, more preferably from about 0.07% to about 0.4%, by weight of the ADD compositions.

Hydrogen Peroxide Source

Hydrogen peroxide sources are described in detail in the hereinabove incorporated Kirk Othmer's Encyclopedia of Chemical Technology, 4th Ed (1992, John Wiley & Sons), Vol. 4, pp. 271–300 "Bleaching Agents (Survey)", and include the various forms of sodium perborate and sodium percarbonate, including various coated and modified forms. An "effective amount" of a source of hydrogen peroxide is any amount capable of measurably improving stain removal (especially of tea stains) from soiled dishware compared to a hydrogen peroxide source-free composition when the soiled dishware is washed by the consumer in a domestic automatic dishwasher in the presence of alkali.

More generally a source of hydrogen peroxide herein is any convenient compound or mixture which under consumer use conditions provides an effective amount of hydrogen peroxide. Levels may vary widely and are usually in the range from about 0.1% to about 70%, more typically from about 0.5% to about 30%, by weight of the ADD compositions herein.

The preferred source of hydrogen peroxide used herein can be any convenient source, including hydrogen peroxide itself. For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Sodium perborate monohydrate and sodium percarbonate are particularly preferred. Mixtures of any convenient hydrogen peroxide sources can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with a silicate, borate or water-soluble surfactants. Percarbonate is available from various commercial sources such as FMC, Solvay and Tokai Denka.

While effective bleaching compositions herein may comprise only the identified cobalt catalysts and a source of hydrogen peroxide, fully-formulated ADD compositions typically will also comprise other automatic dishwashing detergent adjunct materials to improve or modify performance. These materials are selected as appropriate for the properties required of an automatic dishwashing composition. For example, low spotting and filming is desired—preferred compositions have spotting and filming grades of 3 or less, preferably less than 2, and most preferably less than 1, as measured by the standard test of The American Society for Testing and Materials ("ASTM") D3556–85 (Reapproved 1989) "Standard Test Method for Deposition on Glassware During Mechanical Dishwashing". Also for example, low sudsing is desired—preferred compositions produce less than 2 inches, more preferably less than 1 inch, of suds in the bottom of the dishwashing machine during normal use conditions (as determined using known methods such as, for example, that described in U.S. Pat. No. 5,294,365, to Welch et al., issued Mar. 15, 1994).

Adjunct Materials:

Detersive ingredients or adjuncts optionally included in the instant compositions can include one or more materials for assisting or enhancing cleaning performance, treatment of the substrate to be cleaned, or designed to improve the aesthetics of the compositions. They are further selected based on the form of the composition, i.e., whether the composition is to be sold as a liquid, paste (semi-solid), or solid form (including tablets and the preferred granular forms for the present compositions) Adjuncts which can also be included in compositions of the present invention, at their conventional art-established levels for use (generally, adjunct materials comprise, in total, from about 30% to about 99.9%, preferably from about 70% to about 95%, by weight of the compositions), include other active ingredients such as dispersant polymers (e.g., from BASF Corp. or Rohm & Haas), color speckles, silvercare, anti-tanish and/or anti-corrosion agents, dyes, fillers, germicides, alkalinity sources, hydrotropes, anti-oxidants, enzyme stabilizing agents, perfumes, solubilizing agents, carriers, processing aids, pigments, and, for liquid formulations, solvents, as described in detail hereinafter.

1. Detergent Surfactants:

(a) Low-Foaming Nonionic Surfactant—Surfactants are useful in Automatic Dishwashing to assist cleaning, help defoam food soil foams, especially from proteins, and to help control spotting/filming and are desirably included in the present detergent compositions at levels of from about 0.1% to about 20% of the composition. In general, bleach-stable surfactants are preferred. ADD (Automatic Dishwashing Detergent) compositions of the present invention prefereably comprise low foaming nonionic surfactants (LFNIs). LFNI can be present in amounts from 0 to about 10% by weight, preferably from about 0.25% to about 4%. LFNIs are most typically used in ADDs on account of the improved water-sheeting action (especially from glass) which they confer to the ADD product. They also encompass non-silicone, nonphosphate polymeric materials further illustrated hereinafter which are known to defoam food soils encountered in automatic dishwashing.

Preferred LFNIs include nonionic alkoxylated surfactants, especially ethoxy-lates derived from primary alcohols, and blends thereof with more sophisticated surfactants, such as the polyoxypropylene/polyoxyethylene/polyoxypropylene (PO/EO/PO) reverse block polymers. The PO/EO/PO polymer-type surfactants are well-known to have foam suppressing or defoaming action, especially in relation to common food soil ingredients such as egg.

The invention encompasses preferred embodiments wherein LFNI is present, and wherein this component is solid at about 95° F. (35° C.), more preferably solid at about 77° F. (25° C.). For ease of manufacture, a preferred LFNI has a melting point between about 77° F. (25° C.) and about 140° F. (60° C.), more preferably between about 80° F. (26.60° C.) and 110° F. (43.3° C.).

In a preferred embodiment, the LFNI is an ethoxylated surfactant derived from the reaction of a monohydroxy alcohol or alkylphenol containing from about 8 to about 20 carbon atoms, with from about 6 to about 15 moles of ethylene oxide per mole of alcohol or alkyl phenol on an average basis.

A particularly preferred LFNI is derived from a straight chain fatty alcohol containing from about 16 to about 20 carbon atoms ($C_{16}$–$C_{20}$ alcohol), preferably a $C_{18}$ alcohol, condensed with an average of from about 6 to about 15 moles, preferably from about 7 to about 12 moles, and most preferably from about 7 to about 9 moles of ethylene oxide per mole of alcohol. Preferably the ethoxylated nonionic surfactant so derived has a narrow ethoxylate distribution relative to the average.

The LFNI can optionally contain propylene oxide in an amount up to about 15% by weight. Other preferred LFNI surfactants can be prepared by the processes described in U.S. Pat. No. 4,223,163, issued Sep. 16, 1980, Builloty, incorporated herein by reference.

Highly preferred ADDs herein wherein the LFNI is present make use of ethoxylated monohydroxy alcohol or alkyl phenol and additionally comprise a polyoxyethylene, polyoxypropylene block polymeric compound; the ethoxylated monohydroxy alcohol or alkyl phenol fraction of the LFNI comprising from about 20% to about 100%, preferably from about 30% to about 70% of the total LFNI.

Suitable block polyoxyethylene-polyoxypropylene polymeric compounds that meet the requirements described hereinbefore include those based on ethylene glycol, propylene glycol, glycerol, trimethylolpropane and ethylenediamine as initiator reactive hydrogen compound. Polymeric compounds made from a sequential ethoxylation and propoxylation of initiator compounds with a single reactive hydrogen atom, such as $C_{12-18}$ aliphatic alcohols, do not generally provide satisfactory suds control in the instant ADDs. Certain of the block polymer surfactant compounds designated PLURONIC® and TETRONIC® by the BASF-Wyandotte Corp., Wyandotte, Mich., are suitable in ADD compositions of the invention.

A particularly preferred LFNI contains from about 40% to about 70% of a polyoxypropylene/polyoxyethylene/polyoxypropylene block polymer blend comprising about 75%, by weight of the blend, of a reverse block co-polymer of polyoxyethylene and polyoxypropylene containing 17 moles of ethylene oxide and 44 moles of propylene oxide, and about 25%, by weight of the blend, of a block co-polymer of polyoxyethylene and polyoxypropylene initiated with trimethylolpropane and containing 99 moles of propylene oxide and 24 moles of ethylene oxide per mole of trimethylolpropane.

Suitable for use as LFNI in the ADD compositions are those LFNI having relatively low cloud points and high hydrophilic-lipophilic balance (HLB). Cloud points of 1% solutions in water are typically below about 32° C. and preferably lower, e.g., 0° C., for optimum control of sudsing throughout a full range of water temperatures.

LFNIs which may also be used include a $C_{18}$ alcohol polyethoxylate, having a degree of ethoxylation of about 8, commercially available as SLF18 from Olin Corp., and any biodegradable LFNI having the melting point properties discussed hereinabove.

(b) Anionic Co-surfactant—The automatic dishwashing detergent compositions herein are preferably substantially free from anionic co-surfactants. It has been discovered that certain anionic co-surfactants, particularly fatty carboxylic acids, can cause unsightly films on dishware. Moreover, many anionic surfactants are high foaming. If present, the anionic co-surfactant is typically of a type having good solubility in the presence of calcium. Such anionic co-surfactants are further illustrated by sulfobetaines, alkyl(polyethoxy)sulfates (AES), alkyl (polyethoxy)carboxylates, and short chained $C_6$–$C_{10}$ alkyl sulfates.

2. Detersive Enzymes

"Detersive enzyme", as used herein, means any enzyme having a cleaning, stain removing or otherwise beneficial effect in an ADD composition. Preferred detersive enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

In general, as noted, preferred ADD compositions herein comprise one or more detersive enzymes. If only one enzyme is used, it is preferably an amyolytic enzyme when the composition is for automatic dishwashing use. Highly preferred for automatic dishwashing is a mixture of proteolytic enzymes and amyloytic enzymes.

More generally, the enzymes to be incorporated include proteases, amylases, lipases, cellulases, and peroxidases, as well as mixtures thereof Other types of enzymes may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fungal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics, dishware and the like. Since enzymes are catalytic materials, such amounts may be very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.001% to about 6%, preferably 0.01%–1% by weight of a commercial enzyme preparation. Protease enzymes are usually present in such commercial preparations at levels sufficient to provide from 0.005 to 0.1 Anson units (AU) of activity per gram of composition. For automatic dishwashing purposes, it may be desirable to increase the active enzyme content of the commercial preparations, in order to minimize the total amount of non-catalytically active materials delivered and thereby improve spotting/filming results.

Suitable examples of proteases are the subtilisins which are obtained from particular strains of *B. sublilis* and *B. licheniformis*. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, +197, +204, +206, +210, +216, +217, +218, +222, +260, +265, and/or +274 according to the numbering of *Bacillus amyloliquefaciens* subtilisin, as described in the patent applications of A. Baeck, et al, entitled "Protease-Containing Cleaning Compositions" having U.S. Ser. No. 08/322,676, and C. Ghosh, et al, "Bleaching Compositions Comprising Protease Enzymes" having U.S. Ser. No. 08/322,677, both filed Oct. 13, 1994.

Amylases suitable herein include, for example, α-amylases described in British Patent Specification No. 1,296,839 (Novo), RAPIDASE®, International Bio-synthetics, Inc. and TERMAMYL®, Novo Industries.

Engineering of enzymes (e.g., stability-enhanced amylase) for improved stability, e.g., oxidative stability is known. See, for example J.Biological Chem., Vol. 260, No. 11, Jun. 1985, pp 6518–6521. "Reference amylase" refers to a conventional amylase inside the scope of the amylase component of this invention. Further, stability-enhanced amylases, also within the invention, are typically compared to these "reference amylases".

The present invention, in certain preferred embodiments, can makes use of amylases having improved stability in detergents, especially improved oxidative stability. A convenient absolute stability reference-point against which amylases used in these preferred embodiments of the instant invention represent a measurable improvement is the stability of TERMAMYL® in commercial use in 1993 and available from Novo Nordisk A/S. This TERMAMYL® amylase is a "reference amylase", and is itself well-suited for use in the ADD (Automatic Dishwashing Detergent) compositions of the invention. Even more preferred amylases herein share the characteristic of being "stability-enhanced" amylases, characterized, at a minimum, by a measurable improvement in one or more of: oxidative stability, e.g., to hydrogen peroxide/tetraacetylethylenedianine in buffered solution at pH 9–10; thermal stability, e.g., at common wash temperatures such as about 60° C.; or alkaline stability, e.g., at a pH from about 8 to about 11, all measured versus the above-identified reference-amylase. Preferred amylases herein can demonstrate further improvement versus more challenging reference amylases, the latter reference amylases being illustrated by any of the precursor amylases of which preferred amylases within the invention are variants. Such precursor amylases may themselves be natural or be the product of genetic engineering. Stability can be measured using any of the art-disclosed technical tests. See references disclosed in WO 94/02597, itself and documents therein referred to being incorporated by reference.

In general, stabilityenhanced amylases respecting the preferred embodiments of the invention can be obtained from Novo Nordisk A/S, or from Genencor International.

Preferred amylases herein have the commonality of being derived using site-directed mutagenesis from one or more of the Baccillus amylases, especialy the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B.licheniformis* alpha-amylase, known as TERMAMYL®, or the homologous position variation of a similar parent amylase, such as *B.amyloliquefaciens, B.subtilis,* or *B.stearothermophilus;*

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B.licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE® and SUNLIGHT®;

(c) Particularly preferred herein are amylase variants having additional modification in the immediate parent available from Novo Nordisk A/S. These amylases do not yet have a tradename but are those referred to by the supplier as QL37+M197T.

Any other oxidative stability enhanced amylase can be used, for example as derived by site-directed mutagenesis from known chimeric, hybrid or simple mutant parent forms of available amylases.

Cellulases usable in, but not preferred, for the present invention include both bacterial or fungal cellulases. Typically, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (*Dolabella Auricula Solander*). Suitable cellulases are also disclosed in GB-A-2.075.028; GB-A-2.095.275 and DE-OS-2.247.832. CAREZYME® (Novo) is especially useful.

Suitable lipase enzymes for detergent use include those produced by microorganisms of the Pseudomonas group, such as *Pseudomonas stuizeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscosum,* e.g. *Chromobacter viscosum var. lipolyticum* NRRLB 3673, commercially available from Toyo Jozo Co., Tagata, Japan; and further *Chromobacter viscosum* lipases from U.S. Biochemical Corp., U.S.A. and Disoynth Co., The Netherlands, and lipases ex *Pseudomonas gladioli.* The LIPOLASE® enzyme derived from *Humicola lanuginosa* and commercially available from Novo (see also EPO 341,947) is a preferred lipase for use herein. Another preferred lipase enzyme is the D96L variant of the native *Humicola lanuginosa* lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

(a) Enzyme Stabilizing System—The enzyme-containing compositions, especially liquid compositions, herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such stabilizing systems can comprise calcium ion, boric acid, propylene glycol, short chain carboxylic acid, boronic acid, and mixtures thereof The stabilizing system of the ADDs herein may further comprise from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme during dishwashing is relatively large; accordingly, enzyme stability in-use can be problematic.

Suitable chlorine scavenger anions are widely known and readily available, and are illustrated by salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired. In general, since the chlorine scavenger function can be performed by several of the ingredients separately listed under better recognized functions, (e.g., other components of the invention such as sodium perborate), there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any scavenger which is majorly incompatible with other ingredients, if used. In relation to the use of ammonium salts, such salts can be simply admixed with the detergent composition but are prone to adsorb water and/or liberate ammonia during storage. Accordingly, such materials, if present, are desirably protected in a particle such as that described in U.S. Pat. No. 4,652,392, Baginski et al.

3. Optional Bleach Adjuncts (a) Bleach Activators—Bleach activator components are optional materials for the inventive compositions. Such activators are typified by TAED (tetraacetylethylenediamine). Numerous conventional activators are known. See for example U.S. Pat. No. 4,915,854, issued Apr. 10, 1990 to Mao et al, and U.S. Pat. No. 4,412,934. Nonanoyloxybenzene sulfonate (NOBS) or acyl lactam activators may be used, and mixtures thereof with TAED can also be used. See also U.S. Pat. No. 4,634,551 for other typical conventional bleach activators. Also known are amido-derived bleach activators of the formulae: $R^1N(R^5)C(O)R^2C(O)L$ or $R^1C(O)N(R^5)R^2C(O)L$ wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about I to about 10 carbon atoms, and L is any suitable leaving group other than an alpha-modified lactam. Further illustration of bleach activators of the above formulae include (6-octanamido-caproyl)oxybenzenesulfonate, (6-nonanamidocaproyl)oxybenzenesulfonate, (6-decanamido-caproyl)oxybenzenesulfonate, and mixtures thereof as described in U.S. Pat. No. 4,634,551. Another class of bleach activators comprises the benzoxazin-type activators disclosed by Hodge et al in U.S. Pat. No. 4,966,723, issued Oct. 30, 1990. Still another class of bleach activators includes acyl lactam activators such as octanoyl caprolactam, 3,5,5-trimethylhexanoyl caprolactam, nonanoyl caprolactam, decanoyl caprolactam, undecenoyl caprolactam, octanoyl valerolactam, decanoyl valerolactam, undecenoyl valerolactam, nonanoyl valerolactam, 3,5,5-trimethyl-hexanoyl valerolactam and mixtures thereof The present compositions can optionally comprise acyl benzoates, such as phenyl benzoate.

(b) Organic Peroxides, especially Diacyl Peroxides—These are extensively illustrated in Kirk Othmer, Encyclopedia of Chemical Technology, Vol. 17, John Wiley and Sons, 1982 at pages 27–90 and especially at pages 63–72, all incorporated herein by reference. If a diacyl peroxide is used, it will preferably be one which exerts minimal adverse impact on spotting/filming.

4. pH and Buffering Variation

Many detergent compositions herein will be buffered, i.e., they are relatively resistant to pH drop in the presence of acidic soils. However, other compositions herein may have exceptionally low buffering capacity, or may be substantially unbuffered. Techniques for controlling or varying pH at recommended usage levels more generally include the use of not only buffers, but also additional alkalis, acids, pH-jump systems, dual compartment containers, etc., and are well known to those skilled in the art.

The preferred ADD compositions herein comprise a pH-adjusting component selected from water-soluble alkaline inorganic salts and water-soluble organic or inorganic builders. The pH-adjusting components are selected so that when the ADD is dissolved in water at a concentration of 1,000–5,000 ppm, the pH remains in the range of above about 8, preferably from about 9.5 to about 11. The preferred nonphosphate pH-adjusting component of the invention is selected from the group consisting of:

(i) sodium carbonate or sesquicarbonate;

(ii) sodium silicate, preferably hydrous sodium silicate having $SiO_2$:$Na_2O$ ratio of from about 1:1 to about 2:1, and mixtures thereof with limited quantites of sodium metasilicate;

(iii) sodium citrate;

(iv) citric acid;

(v) sodium bicarbonate, (vi) sodium borate, preferably borax;

(vii) sodium hydroxide, and (viii) mixtures of (i)–(vii).

Preferred embodiments contain low levels of silicate (i.e. from about 3% to about 10% $SiO_2$).

Illustrative of highly preferred pH-adjusting component systems are binary mixtures of granular sodium citrate with anhydrous sodium carbonate, and three-component mixtures of granular sodium citrate trihydrate, citric acid monohydrate and anhydrous sodium carbonate.

The amount of the pH adjusting component in the instant ADD compositions is preferably from about 1% to about 50%, by weight of the composition. In a preferred embodiment, the pH-adjusting component is present in the ADD composition in an amount from about 5% to about 40%, preferably from about 10% to about 30%, by weight.

For compositions herein having a pH between about 9.5 and about 11 of the initial wash solution, particularly preferred ADD embodiments comprise, by weight of ADD, from about 5% to about 40%, preferably from about 10% to about 30%, most preferably from about 15% to about 20%, of sodium citrate with from about 5% to about 30%, preferably from about 7% to 25%, most preferably from about 8% to about 20% sodium carbonate.

The essential pH-adjusting system can be complemented (i.e. for improved sequestration in hard water) by other optional detergency builder salts selected from nonphosphate detergency builders known in the art, which include the various water-soluble, soluble, alkali metal, ammonium or substituted ammonium borates, hydroxysulfonates, polyacetates, and polycarboxylates. Preferred are the alkali metal, especially sodium, salts of such materials. Alternate water-soluble, non-phosphorus organic builders can be used for their sequestering properties. Examples of polyacetate and polycarboxylate builders are the sodium, potassium, lithium, ammonium and substituted ammonium salts of ethylenediamine tetraacetic acid; nitrilotriacetic acid, tartrate monosuccinic acid, tartrate disuccinic acid, oxydisuccinic acid, carboxymethoxysuccinic acid, mellitic acid, and sodium benzene polycarboxylate salts.

(a) Water-Soluble Silicates

The present automatic dishwashing detergent compositions may further comprise water-soluble silicates. Water-soluble silicates herein are any silicates which are soluble to the extent that they do not adveresely affect spotting/filming characteristics of the ADD composition.

Examples of silicates are sodium metasilicate and, more generally, the alkali metal silicates, particularly those having a $SiO_2$:$Na_2O$ ratio in the range 1.6:1 to 3.2:1; and layered silicates, such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, Na SKS-6 and other water-soluble silicates usefule herein do not contain aluminum. NaSKS-6 is the $\delta$-$Na_2SiO_5$ form of layered silicate and can be prepared by methods such as those described in German DE-A-3,417,649 and DE-A-3,742,043. SKS-6 is a preferred layered silicate for use herein, but other such layered silicates, such as those having the general formula $NaMSi_xO_{2x+1}yH_2O$ wherein M is sodium or hydrogen, x is a number from 1.9 to 4, preferably 2, and y is a number from 0 to 20, preferably 0 can be used. Various other layered silicates from Hoechst include NaSKS-5, NaSKS-7 and NaSKS- II, as the $\alpha$-, $\beta$- and $\gamma$- forms. Other silicates may also be useful, such as for example magnesium silicate, which can serve as a crispening agent in granular formulations, as a stabilizing agent for oxygen bleaches, and as a component of suds control systems.

Silicates particularly useful in automatic dishwashing (ADD) applications include granular hydrous 2-ratio silicates such as BRITESIL® H20 from PQ Corp., and the commonly sourced BRITESIL® H24 though liquid grades of various silicates can be used when the ADD composition has liquid form. Within safe limits, sodium metasilicate or sodium hydroxide alone or in combination with other silicates may be used in an ADD context to boost wash pH to a desired level.

5. Builders—Detergent builders other than silicates can optionally be included in the compositions herein to assist in controlling mineral hardness. Inorganic as well as organic builders can be used. Builders are typically used in automatic dishwashing and fabric laundering compositions, for example to assist in the removal of particulate soils.

The level of builder can vary widely depending upon the end use of the composition and its desired physical form. When present, the compositions will typically comprise at least about 1% builder. High performance compositions typically comprise from about 10% to about 80%, more typically from about 15% to about 50% by weight, of the detergent builder. Lower or higher levels of builder, however, are not excluded.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulfates, and aluminosilicates. However, non-phosphate builders are required in some locales. Compositions herein function surprisingly well even in the presence of "weak" builders (as compared with phosphates) such as citrate, or in the so-called "underbuilt" situation that may occur with zeolite or layered silicate builders. See U.S. Pat. No. 4,605,509 for examples of preferred aluminosilicates.

Examples of carbonate builders are the alkaline earth and alkali metal carbonates as disclosed in German Patent Application No. 2,321,001 published on Nov. 15, 1973. Various grades and types of sodium carbonate and sodium sesquicarbonate may be used, certain of which are particularly useful as carriers for other ingredients, especially detersive surfactants.

Aluminosilicate builders may be used in the present compositions though are not preferred for automatic dishwashing detergents. Aluminosilicate builders are of great importance in most currently marketed heavy duty granular detergent compositions, and can also be a significant builder ingredient in liquid detergent formulations. Aluminosilicate builders include those having the empirical formula: $NA_2O.AL_2O_3.xSiO_z.yH_2O$ wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krunmmel, et al, issued Oct. 12, 1976. Preferred synthetic crystalline aluminosilicate ion exchange materials useful herein are available under the designations Zeolite A, Zeolite P(B), Zeolite MAP and Zeolite X. In another embodiment, the crystalline aluminosilicate ion exchange material has the formula: $Na_{12}[(AlO_2)_{12}(SiO_2)_{12}].xH_2O$ wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter. Individual particles can desirably be even smaller than 0.1 micron to further assist kinetics of exchange through maximization of surface area. High surface area also increases utility of aluminosilicates as adsorbents for surfactants, especially in granular compositions. Aggregates of silicate or aluminosilicate particles may be useful, a single aggregate having dimensions tailored to minimize segregation in granular compositions, while the aggregate particle remains dispersible to submicron individual particles during the wash. As with other builders such as carbonates, it may be desirable to use zeolites in any physical or morphological form adapted to promote surfactant carrier function, and appropriate particle sizes may be freely selected by the formulator.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. No. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1, 3, 5-trihydroxy benzene-2, 4, 6-trisulphonic acid, and carboxymethyloxysuccinic acid, the various alkali metal, ammonium and substituted ammonium salts of polyacetic acids such as ethylenediaminetetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof Citrate builders, e.g., citric acid and soluble salts thereof (particularly sodium salt), are polycarboxylate builders of particular importance for heavy duty laundry detergent and automatic dishwashing formulations due to their availability from renewable resources and their biodegradability. Citrates can also be used in combination with zeolite, the aforementioned BRITESIL types, and/or layered silicate builders. Oxydisuccinates are also useful in such compositions and combinations.

Also suitable in the detergent compositions of the present invention are the 3,3-dicarboxy4-oxa-1,6-hexanedionates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also U.S. Pat. No. 3,723,322.

Fatty acids, e.g., $C_{12}$–$C_{18}$ monocarboxylic acids, may also be incorporated into the compositions alone, or in combination with the aforesaid builders, especially citrate and/or the succinate builders, to provide additional builder activity but are generally not desired. Such use of fatty acids will generally result in a diminution of sudsing in laundry compositions, which may need to be be taken into account by the formulator. Fatty acids or their salts are undesirable in Automatic Dishwashing (ADD) embodiments in situations wherein soap scums can form and be deposited on dishware.

Where phosphorus-based builders can be used, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used though such materials are more commonly used in a low-level mode as chelants or stabilizers.

6. Chelating Agents

The compositions herein may also optionally contain one or more transition-metal selective sequestrants, "chelants" or "chelating agents", e.g., iron and/or copper and/or manganese chelating agents. Chelating agents suitable for use herein can be selected from the group consisting of aminocarboxylates, phosphonates (especially the aminophosphonates), polyfunctionally-substituted aromatic chelating agents, and mixtures thereof Without intending to be bound by theory, it is believed that the benefit of these materials is due in part to their exceptional ability to control iron, copper and manganese in washing solutions; other benefits include inorganic film prevention or scale inhibition. Commercial chelating agents for use herein include the DEQUEST® series, and chelants from Monsanto, DuPont, and Nalco, Inc.

Aminocarboxylates useful as optional chelating agents are further illustrated by ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts thereof In general, chelant mixtures may be used for a combination of functions, such as multiple transition-metal control, long-term product stabilization, and/or control of precipitated transition metal oxides and/or hydroxides.

Polyfunctionally-substituted aromatic chelating agents are also useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A highly preferred biodegradable chelator for use herein is ethylenediamine disuccinate ("EDDS"), especially (but not limited to) the [S,S] isomer as described in U.S. Pat. No. 4,704,233, Nov. 3, 1987, to Hartman and Perkins. The trisodium salt is preferred though other forms, such as magnesium salts, may also be useful.

Aminophosphonates are also suitable for use as chelating agents in the compositions of the invention when at least low levels of total phosphorus are acceptable in detergent compositions, and include the ethylenediaminetetrakis (methylenephosphonates) and the diethylenetriaminepentakis (methylene phosphonates). Preferably, these aminophosphonates do not contain alkyl or alkenyl groups with more than about 6 carbon atoms.

If utilized, chelating agents or transition-metal-selective sequestrants will preferably comprise from about 0.001% to about 10%, more preferably from about 0.05% to about 1% by weight of the compositions herein.

7. Dispersant Polymer—Preferred ADD compositions herein may additionally contain a dispersant polymer. When present, a dispersant polymer in the instant ADD compositions is typically at levels in the range from 0 to about 25%, preferably from about 0.5% to about 20%, more preferably from about 1% to about 8% by weight of the ADD composition. Dispersant polymers are useful for improved filming performance of the present ADD compositions, especially in higher pH embodiments, such as those in which wash pH exceeds about 9.5. Particularly preferred are polymers which inhibit the deposition of calcium carbonate or magnesium silicate on dishware.

Dispersant polymers suitable for use herein are further illustrated by the film-forming polymers described in U.S. Pat. No. 4,379,080 (Murphy), issued Apr. 5, 1983.

Suitable polymers are preferably at least partially neutralized or alkali metal, ammonium or substituted ammonium (e.g., mono-, di- or triethanolammonium) salts of polycarboxylic acids. The alkali metal, especially sodium salts are most preferred. While the molecular weight of the polymer can vary over a wide range, it preferably is from about 1,000 to about 500,000, more preferably is from about 1,000 to about 250,000, and most preferably, especially if the ADD is for use in North American automatic dishwashing appliances, is from about 1,000 to about 5,000.

Other suitable dispersant polymers include those disclosed in U.S. Pat. No. 3,308,067 issued Mar. 7, 1967, to Diehl. Unsaturated monomeric acids that can be polymerized to form suitable dispersant polymers include acrylic acid, maleic acid (or maleic anhydride), fumaric acid, itaconic acid, aconitic acid, mesaconic acid, citraconic acid and methylenemalonic acid. The presence of monomeric segments containing no carboxylate radicals such as methyl vinyl ether, styrene, ethylene, etc. is suitable provided that such segments do not constitute more than about 50% by weight of the dispersant polymer.

Copolymers of acrylamide and acrylate having a molecular weight of from about 3,000 to about 100,000, preferably from about 4,000 to about 20,000, and an acrylamide content of less than about 50%, preferably less than about 20%, by weight of the dispersant polymer can also be used. Most preferably, such dispersant polymer has a molecular weight of from about 4,000 to about 20,000 and an acrylamide content of from about 0% to about 15%, by weight of the polymer.

Particularly preferred dispersant polymers are low molecular weight modified polyacrylate copolymers. Such copolymers contain as monomer units: a) from about 90% to about 10%, preferably from about 80% to about 20% by weight acrylic acid or its salts and b) from about 10% to about 90%, preferably from about 20% to about 80% by weight of a substituted acrylic monomer or its salt and have the general formula: —[$(C(R^2)C(R^1)(C(O)OR^3)$] wherein the apparently unfilled valencies are in fact occupied by hydrogen and at least one of the substituents $R^1$, $R^2$, or $R^3$, preferably $R^1$ or $R^2$, is a 1 to 4 carbon alkyl or hydroxyalkyl group; $R^1$ or $R^2$ can be a hydrogen and $R^3$ can be a hydrogen or alkali metal salt. Most preferred is a substituted acrylic monomer wherein $R^1$ is methyl, $R^2$ is hydrogen, and $R^3$ is sodium.

Suitable low molecular weight polyacrylate dispersant polymer preferably has a molecular weight of less than about 15,000, preferably from about 500 to about 10,000, most preferably from about 1,000 to about 5,000. The most preferred polyacrylate copolymer for use herein has a molecular weight of about 3,500 and is the fully neutralized form of the polymer comprising about 70% by weight acrylic acid and about 30% by weight methacrylic acid.

Other suitable modified polyacrylate copolymers include the low molecular weight copolymers of unsaturated aliphatic carboxylic acids disclosed in U.S. Pat. Nos. 4,530,766, and 5,084,535.

Agglomerated forms of the present ADD compositions may employ aqueous solutions of polymer dispersants as liquid binders for making the agglomerate (particularly when the composition consists of a mixture of sodium citrate and sodium carbonate). Especially preferred are polyacrylates with an average molecular weight of from about 1,000 to about 10,000, and acrylate/maleate or acrylate/fumarate copolymers with an average molecular weight of from about 2,000 to about 80,000 and a ratio of acrylate to maleate or fumarate segments of from about 30:1 to about 1:2. Examples of such copolymers based on a mixture of unsaturated mono- and dicarboxylate monomers are disclosed in European Patent Application No. 66,915, published Dec. 15, 1982.

Other dispersant polymers useful herein include the polyethylene glycols and polypropylene glycols having a molecular weight of from about 950 to about 30,000 which can be obtained from the Dow Chemical Company of Midland, Mich. Such compounds for example, having a melting point within the range of from about 30° C. to about 100° C., can be obtained at molecular weights of 1,450, 3,400, 4,500, 6,000, 7,400, 9,500, and 20,000. Such compounds are formed by the polymerization of ethylene glycol or propylene glycol with the requisite number of moles of ethylene or propylene oxide to provide the desired molecular weight and melting point of the respective polyethylene glycol and polypropylene glycol. The polyethylene, polypropylene and mixed glycols are referred to using the formula:

$$HO(CH_2CH_2O)_m(CH_2CH(CH_3)O)_n(CH(CH_3)CH_2O)_oOH$$

wherein m, n, and o are integers satisfying the molecular weight and temperature requirements given above.

Yet other dispersant polymers useful herein include the cellulose sulfate esters such as cellulose acetate sulfate, cellulose sulfate, hydroxyethyl cellulose sulfate, methylcellulose sulfate, and hydroxypropylcellulose sulfate. Sodium cellulose sulfate is the most preferred polymer of this group.

Other suitable dispersant polymers are the carboxylated polysaccharides, particularly starches, celluloses and alginates, described in U.S. Pat. No. 3,723,322, Diehl, issued Mar. 27, 1973; the dextrin esters of polycarboxylic acids disclosed in U.S. Pat. No. 3,929,107, Thompson, issued Nov. 11, 1975; the hydroxyalkyl starch ethers, starch esters, oxidized starches, dextrins and starch hydrolysates described in U.S. Pat No. 3,803,285, Jensen, issued Apr. 9, 1974; the carboxylated starches described in U.S. Pat. No. 3,629,121, Eldib, issued Dec. 21, 1971; and the dextrin starches described in U.S. Pat. No. 4,141,841, McDonald, issued Feb. 27, 1979. Preferred cellulose-derived dispersant polymers are the carboxymethyl celluloses.

Yet another group of acceptable dispersants are the organic dispersant polymers, such as polyaspartate.

8. Material Care Agents—The present ADD compositions may contain one or more material care agents which are effective as corrosion inhibitors and/or anti-tarnish aids. Such materials are preferred components of machine dishwashing compositions especially in certain European countries where the use of electroplated nickel silver and sterling silver is still comparatively common in domestic flatware, or when aluminium protection is a concern and the composition is low in silicate. Generally, such material care agents include metasilicate, silicate, bismuth salts, manganese salts, paraffin, triazoles, pyrazoles, thiols, mercaptans, aluminium fatty acid salts, and mixtures thereof When present, such protecting materials are preferably incorporated at low levels, e.g., from about 0.01% to about 5% of the ADD composition. Suitable corrosion inhibitors include paraffin oil, typically a predominantly branched aliphatic hydrocarbon having a number of carbon atoms in the range of from about 20 to about 50; preferred paraffin oil is selected from predominantly branched $C_{25-45}$ species with a ratio of cyclic to noncyclic hydrocarbons of about 32:68. A paraffin oil meeting those characteristics is sold by Wintershall, Salzbergen, Germany, under the trade name WINOG 70. Additionally, the addition of low levels of bismuth nitrate (i.e., $Bi(NO_3)_3$) is also preferred.

Other corrosion inhibitor compounds include benzotriazole and comparable compounds; mercaptans or thiols including thionaphtol and thioanthranol; and finely divided Aluminium fatty acid salts, such as aluminium tristearate. The formulator will recognize that such materials will generally be used judiciously and in limited quantities so as to avoid any tendency to produce spots or films on glassware or to compromise the bleaching action of the compositions. For this reason, mercaptan anti-tarnishes which are quite strongly bleach-reactive and common fatty carboxylic acids which precipitate with calcium in particular are preferably avoided.

9. Silicone and Phosphate Ester Suds Suppressors—The ADD's of the invention can optionally contain an alkyl phosphate ester suds suppressor, a silicone suds suppressor, or combinations thereof Levels in general are from 0% to about 10%, preferably, from about 0.001% to about 5%. Typical levels tend to be low, e.g., from about 0.01% to about 3% when a silicone suds suppressor is used. Preferred non-phosphate compositions omit the phosphate ester component entirely.

Silicone suds suppressor technology and other defoaming agents useful herein are extensively documented in "Defoaming, Theory and Industrial Applications", Ed., P. R. Garrett, Marcel Dekker, N.Y., 1973, ISBN 0-8247-8770-6, incorporated herein by reference. See especially the chapters entitled "Foam control in Detergent Products" (Ferch et al) and "Surfactant Antifoams" (Blease et al). See also U.S. Pat. Nos. 3,933,672 and 4,136,045. Highly preferred silicone suds suppressors are the compounded types known for use in laundry detergents such as heavy-duty granules, although types hitherto used only in heavy-duty liquid detergents may also be incorporated in the instant compositions. For example, polydimethylsiloxanes having trimethylsilyl or alternate endblocking units may be used as the silicone. These may be compounded with silica and/or with surface-active nonsilicon components, as illustrated by a suds suppressor comprising 12% silicone/silica, 18% stearyl alcohol and 70% starch in granular form. A suitable commercial source of the silicone active compounds is Dow Corning Corp.

Levels of the suds suppressor depend to some extent on the sudsing tendency of the composition, for example, an ADD for use at 2000 ppm comprising 2% octadecyldimethylamine oxide may not require the presence of a suds suppressor. Indeed, it is an advantage of the present invention to select cleaning-effective amine oxides which are.inherently much lower in foam-forming tendencies than the typical coco amine oxides. In contrast, formulations in which amine oxide is combined with a high-foaming anionic cosurfactant, e.g., alkyl ethoxy sulfate, benefit greatly from the presence of suds suppressor.

Phosphate esters have also been asserted to provide some protection of silver and silver-plated utensil surfaces; however, the instant compositions can have excellent silvercare without a phosphate ester component. Without being limited by theory, it is believed that lower pH formulations, e.g., those having pH of 9.5 and below, plus the presence of the low level amine oxide, both contribute to improved silver care.

If it is desired nonetheless to use a phosphate ester, suitable compounds are disclosed in U.S. Pat. No. 3,314,891, issued Apr. 18, 1967, to Schmolka et al, incorporated herein by reference. Preferred alkyl phosphate esters contain from 16–20 carbon atoms. Highly preferred alkyl phosphate esters are monostearyl acid phosphate or monooleyl acid phosphate, or salts thereof, particularly alkali metal salts, or mixtures thereof It has been found preferable to avoid the use of simple calcium-precipitating soaps as antifoams in the present compositions as they tend to deposit on the dishware. Indeed, phosphate esters are not entirely free of such problems and the formulator will generally choose to minimize the content of potentially depositing antifoams in the instant compositions.

10. Other Optional Adjuncts—Depending on whether a greater or lesser degree of compactness is required, filler materials can also be present in the instant ADDs. These include sucrose, sucrose esters, sodium sulfate, potassium sulfate, etc., in amounts up to about 70%, preferably from 0% to about 40% of the ADD composition. Preferred filler is sodium sulfate, especially in good grades having at most low levels of trace impurities.

Sodium sulfate used herein preferably has a purity sufficient to ensure it is non-reactive with bleach; it may also be treated with low levels of sequestrants, such as phosphonates or EDDS in magnesium-salt form. Note that preferences, in terms of purity sufficient to avoid decomposing bleach, applies also to pH-adjusting component ingredients, specifically including any silicates used herein.

Although optionally present in the instant compositions, the present invention encompasses embodiments which are substantially free from sodium chloride or potassium chloride.

Hydrotrope materials such as sodium benzene sulfonate, sodium toluene sulfonate, sodium cumene sulfonate, etc., can be present, e.g., for better dispersing surfactant.

Bleach-stable perfumes (stable as to odor); and bleach-stable dyes such as those disclosed in U.S. Pat. No. 4,714,562, Roselle et al, issued Dec. 22, 1987 can also be added to the present compositions in appropriate amounts. Other common detergent ingredients consistent with the spirit and scope of the present invention are not excluded.

Since ADD compositions herein can contain water-sensitive ingredients or ingredients which can co-react when brought together in an aqueous environment, it is desirable to keep the free moisture content of the ADDs at a minimum, e.g., 7% or less, preferably 4% or less of the ADD; and to provide packaging which is substantially impermeable to water and carbon dioxide. Coating measures have been described herein to illustrate a way to protect the ingredients from each other and from air and moisture. Plastic bottles, including refillable or recyclable types, as well as conventional barrier cartons or boxes are another helpful means of assuring maximum shelf-storage stability. As noted, when ingredients are not highly compatible, it may further be desirable to coat at least one such ingredient with a low-foaming nonionic surfactant for protection. There are numerous waxy materials which can readily be used to form suitable coated particles of any such otherwise incompatible components, however, the formulator prefers those materials which do not have a marked tendency to deposit or form films on dishes including those of plastic construction.

Some preferred substantially chlorine bleach-free granular automatic dishwashing compositions of the invention are as follows: a substantially chlorine-bleach free automatic dishwashing composition comprising amylase (e.g., TERMAMYL®) and/or a bleach stable amylase and a bleach system comprising a source of hydrogen peroxide selected from sodium perborate and sodium percarbonate and a cobalt catalyst as defined herein.

There is also contemplated a substantially chlorine-bleach free automatic dishwashing composition comprising an oxidative stability-enhanced amylase and a bleach system comprising a source of hydrogen peroxide selected from sodium perborate and sodium percarbonate, a cobalt catalyst, and TAED or NOBS.

Method for Cleaning:

The present invention also encompasses a method for cleaning soiled tableware comprising contacting said tableware with an aqueous medium comprising a cobalt catalyst, preferably at a concentration of from about 2 ppm to about 10 ppm, as described herein before. Preferred aqueous medium have an initial pH in a wash solution of above about 8, more preferably from about 9.5 to about 12, most preferably from about 9.5 to about 10.5.

This invention also encompasses a method of washing tableware in a domestic automatic dishwashing appliance, comprising treating the soiled tableware in an automatic dishwasher with an aqueous alkaline bath comprising amylase and a cobalt catalyst.

Rinse Aid Compositions and Methods:

The present invention also relates to compositions useful in the rinse cycle of an automatic dishwashing process, such compositions being commonly referred to as "rinse aids". While the hereinbefore described compositions may also be formulated to be used as rinse aid compositions, it is not required for purposes of use as a rinse aid to have a source of hydrogen peroxide present in such compositions (although a source of hyfrogen peroxide is preferred, at least at low levels to at least supplement the carry-over).

The optional inclusion of a source of hydrogen peroxide in a rinse aid composition is possible in view of the fact that a significant level of residual detergent composition is carried over from the wash cycle to the rinse cycle. Thus, when an ADD composition containing a hydrogen peroxide source is used, the source of hydrogen peroxide for the rinse cycle is carry over from the wash cycle. Catalytic activity provided by the cobalt catalyst is thus effective with this carry-over from the wash cycle.

Thus, the present invention further encompasses automatic dishwashing rinse aid compositions comprising: (a) a catalytically effective amount of a cobalt catalyst as described herein, and (b) automatic dishwashing detergent adjunct materials. Preferred compositions comprise a low foaming nonionic surfactant. These compositions are also preferably in liquid or solid form.

The present invention also encompasses methods for washing tableware in a domestic automatic dishwashing appliance, said method comprising treating the soiled tableware during a wash cycle of an automatic dishwasher with an aqueous alkaline bath comprising a source of hydrogen peroxide, followed by treating the tableware in the subsequent rinse cycle with an aqueous bath comprising a cobalt catalyst as described herein.

The following nonlimiting examples further illustrate ADD compositions of the present invention.

EXAMPLES 1–3

The following fully-formulated solid-form automatic dishwashing detergents are prepared:

| | 1<br>% Active | 2<br>% Active | 3<br>% Active |
|---|---|---|---|
| Sodium Citrate | 15.0 | 15.0 | 15.0 |
| Sodium Carbonate | 17.5 | 20.0 | 20.0 |
| Dispersant Polymer (See Note 1) | 6.0 | 6.0 | 6.0 |
| Hydroxyethyldiphosphonate (HEDP, acid) | 1.0 | 0.5 | 0.71 |
| Nonionic Surfactant (SLF18, Olin Corp. or Plurafac) | 2.0 | 2.0 | 2.0 |
| Sodium Perborate Monohydrate (See Note 3) | 1.5 | 1.5 | 1.5 |
| TAED | 2.5 | — | — |
| DTPMP (See Note 4) | 0.13 | — | — |
| Cobalt Catalyst (See Note 2) | 0.2 | 0.07 | 0.4 |
| Savinase 6.0T (protease) | — | 2.0 | 2.0 |
| Savinase 12T (protease) | 2.2 | — | — |
| Termamyl 60T (amylase) | 1.5 | 1.0 | 1.0 |
| BRITESIL H2O PQ Corp. (as $SiO_2$) | 8.0 | 8.0 | 8.0 |
| Meta Silicate (anhydrous) | 1.25 | — | — |
| Paraffin | 0.5 | — | — |
| Benzotriazole | 0.3 | — | — |
| Sulphate, water, monors | Balance to 100% | Balance to 100% | Balance to 100% |

Note 1: Dispersant Polymer: One or more of: Sokolan PA30, BASF Corp., Accusol 480N, Rohm & Haas.
Note 2: $[Co(NH_3)_5Cl]Cl_2$ supplied by Dixon Fine Chemicals.
Note 3: These hydrogen peroxide sources are expressed on a weight % available oxygen basis. To convert to a basis of percentage of the total composition, divide by about 0.15.
Note 4: diethylenetriaminepentakis (methylene phosphonic acid)

EXAMPLE 4

| INGREDIENT | 4A<br>wt % | 4B<br>wt % |
|---|---|---|
| Cobalt Catalyst (See Note 2) | 0.2 | 0.4 |
| Sodium Perborate Monohydrate (See Note 3) | 1.5 | 1.5 |
| Amylase (Termamyl ® 60T, Novo) | 1 | 0 |
| Protease 1 (SAVINASE 12 T, 3.6% active protein) | 2.5 | 0 |
| Protease 2 (Protease D, as 4% active protein) | 0 | 2.5 |
| Trisodium Citrate Dihydrate (anhydrous basis) | 15 | 15 |
| Sodium Carbonate, anhydrous | 20 | 20 |
| BRITESIL H2O, PQ Corp. (as $SiO_2$) | 9 | 8 |
| Diethylenetriaminepentaacetic Acid, Sodium Salt | 0 | 0.1 |
| Ethylenediamine Disuccinate, Trisodium Salt | 0.13 | 0 |
| Hydroxyethyldiphosphonate (HEDP), Sodium Salt | 0.5 | 0.5 |
| Dispersant Polymer (See Note 1) | 8 | 8 |
| Nonionic Surfactant (SLF18, Olin Corp. or LF404, BASF) | 2 | 2 |
| Sodium Sulfate, water, minors | Balance to 100% | Balance to 100% |

Note 1: Dispersant Polymer: One or more of: Sokolan PA30, BASF Corp., Accusol 480N, Rohm & Haas.
Note 2: $[Co(NH_3)_5Cl]Cl_2$ supplicd by Dixon Fine Chemicals
Note 3: These hydrogen peroxide sources are expressed on a weight % available oxygen basis. To convert to a basis of percentage of the total composition, divide by about 0.15.

EXAMPLE 5

The following fully-formulated solid-form automatic dishwashing detergents are prepared:

| INGREDIENT | 5A<br>wt % | 5B<br>wt % |
|---|---|---|
| Cobalt Catalyst (See Note 2) | 0.07 | 0.4 |
| Sodium Perborate Monohydrate (See Note 3) | 0 | 0.1 |
| Sodium Percarbonate (See Note 3) | 1.5 | 1.2 |
| Amylase (QL37 + M197T as 3% active | 1.5 | 1.5 |

-continued

| INGREDIENT | 5A wt % | 5B wt % |
|---|---|---|
| protein, NOVO) | | |
| Protease 1 (SAVINASE 12 T, 3.6% active protein) | 2.5 | 0 |
| Protease 2 (Protease D, as 4% active protein) | 0 | 2.5 |
| Trisodium Citrate Dihydrate (anhydrous basis) | 15 | 15 |
| Sodium Carbonate, anhydrous | 20 | 20 |
| BRITESIL H2O, PQ Corp. (as $SiO_2$) | 9 | 9 |
| Diethylenetriaminepentaacetic Acid, Sodium Salt | 0 | 0.1 |
| Ethylenediamine Disuccinate, Trisodium Salt | 0.13 | 0 |
| Hydroxyethyldiphosphonate (HEDP), Sodium Salt | 0.5 | 0.5 |
| Dispersant Polymer (See Note 1) | 8 | 8 |
| Nonionic Surfactant (SLF18. Olin Corp. or LF404, BASF) | 2 | 2 |
| Sodium Sulfate, water, minors | Balance to 100% | Balance to 100% |

Note 1: Dispersant Polymer: One or more of: Sokolan PA30, BASF Corp., Accusol 480N, Rohm & Haas.
Note 2: $[Co(NH_3)_5Cl]Cl_2$ supplied by Dixon Fine Chemicals.
Note 3: These hydrogen peroxide sources are expressed on a weight % available oxygen basis. To convert to a basis of percentage of the total composition, divide by about 0.15.

EXAMPLE 6

The following fully-formulated solid-form automatic dishwashing detergents are prepared:

| INGREDIENT | 6A wt % | 6B wt % |
|---|---|---|
| Cobalt Catalyst (See Note 2) | 0.2 | 0.07 |
| Sodium Perborate Monohydrate (See Note 3) | 1.5 | 1.5 |
| Amylase (QL37 + M197T as 3% active protein, NOVO) | 1.5 | 1.5 |
| Protease 1 (SAVINASE 12 T, 3.6% active protein) | 2.5 | 0 |
| Protease 2 (Protease D, as 4% active protein) | 0 | 2.5 |
| Trisodium Citrate Dihydrate (anhydrous basis) | 15 | 15 |
| Sodium Carbonate, anhydrous | 20 | 20 |
| BRITESIL H2O, PQ Corp. (as $SiO_2$) | 9 | 8 |
| Sodium Metasilicate Pentahydrate, (as $SiO_2$) | 0 | 3 |
| Diethylenetriaminepentaacetic Acid, Sodium Salt | 0 | 0.1 |
| Ethylenediamine Disuccinate, Trisodium Salt | 0.13 | 0 |
| Hydroxyethyldiphosphonate (HEDP), Sodium Salt | 0.5 | 0.5 |
| Dispersant Polymer (See Note 1) | 8 | 8 |
| Nonionic Surfactant (SLF18, Olin Corp. or LF404, BASF) | 2 | 2 |
| Sodium Sulfate, water, minors | Balance to 100% | Balance to 100% |

Note 1: Dispersant Polymer: One or more of: Sokolan PA30, BASF Corp., Accusol 480N, Rohm & Haas.
Note 2: $[Co(NH_3)_5Cl]Cl_2$ supplied by Dixon Fine Chemicals.
Note 3: These hydrogen peroxide sources are expressed on a weight % available oxygen basis: To convert to a basis of percentage of the total composition, divide by about 0.15.

EXAMPLE 7

| INGREDIENT | 7A wt % | 7B wt % | 7C wt % |
|---|---|---|---|
| Cobalt Catalyst (See Note 2) | 0.7 | 0.2 | 0.3 |
| Sodium Perborate Monohydrate (See Note 3) | 1.5 | 0 | 0.5 |
| Sodium Percarbonate (See Note 3) | 0 | 1.0 | 1.2 |
| Amylase (QL37 + M19T as 3% active protein, NOVO) | 2 | 1.5 | 1 |
| Dibenzoyl Peroxide | 0.8 | 0.8 | 3.0 |
| Bleach Activator (TAED or NOBS) | 0 | 0 | 0.5 |
| Protease 1 (SAVINASE 12 T, 3.6% active protein) | 2.5 | 0 | 0 |
| Protease 2 (Protease D, as 4% active protein) | 0 | 1 | 1 |

-continued

| INGREDIENT | 7A wt % | 7B wt % | 7C wt % |
|---|---|---|---|
| Trisodium Citrate Dihydrate (anhydrous basis) | 15 | 15 | 15 |
| Sodium Carbonate, anhydrous | 20 | 20 | 20 |
| BRITESIL H2O, PQ Corp. (as $SiO_2$) | 7 | 7 | 17 |
| Sodium Metasilicate Pentahydrate, (as SiO2) | 3 | 0 | 0 |
| Diethylenetriaminepentaacetic Acid, Sodium Salt | 0 | 0.1 | 0 |
| Diethylenetriaminepenta(methyl-enephosphonic acid), Sodium Salt | 0.1 | 0 | 0.1 |
| Hydroxyethyldiphosphonate (HEDP), Sodium Salt | 0.5 | 0 | 0.5 |
| Dispersant Polymer (See Note 1) | 6 | 5 | 6 |
| Nonionic Surfactant (SLF18, Olin Corp. or LF404, BASF) | 2 | 2 | 3 |
| Sodium Sulfate, water, minors | Balance to 100% | Balance to 100% | Balance to 100% |

Note 1: Dispersant Polymer: One or more of: Sokolan PA30, BASF Corp., Accusol 480N, Rohm & Haas.
Note 2: $[Co(NH_3)_5Cl]Cl_2$ supplied by Dixon Fine Chemicals.
Note 3: These Hydrogen Peroxide Sources are expressed on an available oxygen basis. To convert to a basis of percentage of the total composition, divide by 0.15

EXAMPLE 8

| INGREDIENT | 8A wt % | 8B wt % | 8C wt % |
|---|---|---|---|
| Cobalt Catalyst (See Note 2) | 0.2 | 0.07 | 0.4 |
| Sodium Perborate Monohydrate (See Note 3) | 1 | 2 | 1 |
| Sodium Percarbonate (See Note 3) | 0 | 0 | 0 |
| Amylase (Termamyl ® from NOVO) | 2 | 1.5 | 0 |
| Dibenzoyl Peroxide | 0 | 0.1 | 1 |
| Bleach Activator (TAED or NOBS) | 0 | 0 | 2 |
| Protease 1 (SAVINASE 12 T. 3.6% active protein) | 2.5 | 0 | 0 |
| Protease 2 (Protease D, as 4% activte protein) | 0 | 1 | 1 |
| Trisodium Citrate Dihydrate (anhydrous basis) | 15 | 30 | 15 |
| Sodium Carbonate, anhydrous | 20 | 0 | 20 |
| BRITESIL H2O, PQ Corp (as $SiO_2$) | 7 | 10 | 8 |
| Sodium Metasilicate Pentahydrate, (as $SiO_2$) | 3 | 0 | 1 |
| Diethylenetriaminepentaacetic Acid, Sodium Salt | 0 | 0.1 | 0 |
| Diethylenetriaminepenta(methylene-phosphonic acid), Sodium Salt. | 0.1 | 0 | 0.1 |
| Hydroxyethyldiphosphonate (HEDP) Sodium Salt | 0.1 | 0 | 0.1 |
| Dispersant Polymer (See Note 1) | 8 | 5 | 6 |
| Nonionic Surfactant (SLF18. Olin Corp. or LF404, BASF) | 1.5 | 2 | 3 |
| Sodium Sulfate, water, minors | Balance to 100% | Balance to 100% | Balance to 100% |

Note 1: Dispersant Polymer: One or more of: Sokolan PA30, BASF Corp., Accusol 480N, Rohm & Haas.
Note 2: $[Co(NH_3)_5Cl]Cl_2$ supplied by Dixon Fine Chemicals.
Note 3: These Hydrogen Peroxide Sources are expressed on an available oxygen basis. To convert to a basis of percentage of the total composition, divide by 0.15

The ADD's of the above dishwashing detergent composition examples are used to wash tea-stained cups, starch-soiled and spaghetti-soiled dishes, milk-soiled glasses, starch, cheese, egg or babyfood- soiled flatware, and tomato-stained plastic spatulas by loading the soiled dishes in a domestic automatic dishwashing appliance and washing using either cold fill, 60° C. peak, or uniformly 45°–50° C. wash cycles with a product concentration of the exemplary compositions of from about 1,000 to about 5,000 ppm, with excellent results.

What is claimed is:

1. An automatic dishwashing composition comprising:

(a) an amount sufficient to provide from about 0.1 ppm to about 50 ppm in aqueous solution of a cobalt catalyst having the formula:

$$[Co(NH_3)_n(X)_m]T_y$$

wherein cobalt is in the +3 oxidation state, n is an integer from 3 to 5; X is one or more labile coordinating moieties; m is an integer from 1 to 3; m+n=6; and T is one or more appropriately selected counteranions present in a number y, where y is an integer from 0 to 3, to obtain a balanced salt;

(b) from about 0.1% to about 30% by weight of the composition of a source of hydrogen peroxide;

(c) from about 0.1% to about 10% by weight of the composition of a low foaming nonionic surfactant having a cloud point of a 1% solution in water of below about 32° C.; and (d) from about 30% to about 99.9% of automatic dishwashing adjunct materials;

wherein a 1% aqueous solution of said automatic dishwashing composition has a pH of less than 11.

2. An automatic dishwashing detergent composition according to claim 1 comprising automatic dishwashing adjunct material selected such that the composition produces less than 2 inches of suds under normal use conditions.

3. An automatic dishwashing detergent composition according to claim 1 comprising as part or all of the automatic dishwashing adjunct material one or more material care agents.

4. An automatic dishwashing detergent composition according to claim 1 comprising as part or all of the automatic dishwashing adjunct material one or more water soluble silicates.

5. An automatic dishwashing detergent composition according to claim 1 comprising as part or all of the automatic dishwashing adjunct material one or more bleach activators.

6. An automatic dishwashing detergent composition according to claim 5 wherein the bleach activator is TAED.

7. An automatic dishwashing detergent composition according to claim 2 comprising a cobalt catalyst of the formula:

$$[Co(NH_3)_5Cl]T_y.$$

8. An automatic dishwashing composition comprising:

(a) an amount sufficient to provide from about 0.1 ppm to about 50 ppm in aqueous solution of a cobalt catalyst having the formula:

$$[Co(NH_3)_5Cl]Cl_2$$

(b) from about 0.1% to about 30% by weight of the composition of a source of hydrogen peroxide selected from the group consisting of perborate, percarbonate, and mixtures therefor;

(c) from about 0.1% to about 10% by weight of the composition of a low foaming nonionic surfactant having a cloud point of a 1% solution in water of below about 32° C.; and (d) from about 30% to about 99.9% of automatic dishwashing adjunct materials formulated to provide a low foaming automatic dishwashing composition for use in an automatic dishwashing machine and selected from the group consisting of builders, proteases, amylases, water soluble silicates, bleach activators and mixtures thereof;

wherein a 1% aqueous solution of said automatic dishwashing composition has a pH of less than 11.

9. An automatic dishwashing detergent composition according to claim 8 comprising automatic dishwashing adjunct material selected such that the composition produces less than 2 inches of suds under normal use conditions.

10. A method of washing tableware in a domestic automatic dishwashing appliance, said method comprising treating the soiled tableware in an automatic dishwasher with an aqueous alkaline bath comprising an automatic dishwashing detergent composition according to claim 1.

11. A method according to claim 10 wherein the cobalt catalyst has the formula:

$$[Co(NH_3)_5Cl]T_y.$$

12. A method of washing tableware in a domestic automatic dishwashing appliance, said method comprising treating the soiled tableware in an automatic dishwasher with an aqueous alkaline bath comprising an automatic dishwashing detergent composition according to claim 8.

13. An automatic dishwashing rinse aid composition comprising:

(a) an amount sufficient to provide from about 0.1 ppm to about 50 ppm in aqueous solution of a cobalt catalyst having the formula:

$$[Co(NH_3)_n(X)_m]T_y$$

wherein cobalt is in the +3 oxidation state, n is an integer from 3 to S; X is one or more labile coordinating moieties; m is an integer from 1 to 3; m+n=6; and T is one or more appropriately selected counteranions present in a number y, where y is an integer from 0 to 3, to obtain a charge balanced salt;

(b) from about 0.1% to about 10% by weight of the composition of a low foaming nonionic surfactant having a cloud point of a 1% solution in water of below about 32° C.; and (c) from about 30% to about 99.9% of automatic dishwashing adjunct materials;

wherein a 1% aqueous solution of said automatic dishwashing rinse aid composition has a pH of less than 11.

14. An automatic dishwashing composition comprising:

(a) an amount sufficient to provide from about 0.1 ppm to about 50 ppm in aqueous solution of a cobalt catalyst having the formula:

$$[Co(NH_3)_5Cl]Cl_2$$

(b) from about 0.1% to about 30% by weight of the composition of a source of hydrogen peroxide selected from the group consisting of perborate, percarbonate, and mixtures therefor;

(c) from about 0.1% to about 10% by weight of the composition of a low foaming nonionic surfactant having a cloud point of a 1% solution in water of below about 32° C.; and (d) from about 30% to about 99.9% of automatic dishwashing adjunct materials formulated to provide a low foaming automatic dishwashing composition for use in an automatic dishwashing machine and selected from the group consisting of builders, proteases, amylases, water soluble silicates, bleach activators and mixtures thereof;

wherein said composition is substantially free from anionic surfactants and a 1% aqueous solution of said automatic dishwashing composition has a pH of less than 11.

* * * * *

UNITED STATES PATENT AND TRADEMARK OFFICE

CERTIFICATE OF CORRECTION

PATENT NO. : 5,804,542

DATED : September 8, 1998

INVENTOR(S) : William Micahel Scheper, et al.

It is certified that error appears in the above-identified patent and that said Letters Patent is hereby corrected as shown below:

ON THE TITLE PAGE:
Item [56] References Cited, please add:

U. S. PATENT DOCUMENTS

| DOCUMENT NUMBER | DATE | NAME | CLASS | SUB CLASS |
|---|---|---|---|---|
| 3,398,096 | 08/20/68 | Rotterdam et al. | 252 | 95 |
| 3,551,338 | 12/29/70 | Rapisarda | 252 | 99 |
| 4,119,557 | 10/10/78 | Postlethwaite | 252 | 99 |
| 4,430,243 | 02/07/84 | Bragg | 252 | 91 |
| 4,478,733 | 10/23/84 | Oakes | 252 | 99 |
| 4,481,129 | 11/06/84 | Oakes | 252 | 186.41 |
| 4,488,980 | 12/18/84 | Oakes | 252 | 99 |
| 4,536,183 | 08/20/85 | Namnath | 8 | 107 |
| 4,539,132 | 09/03/85 | Oakes | 252 | 95 |
| 4,568,477 | 02/04/86 | Oakes | 252 | 99 |
| 4,578,206 | 03/25/86 | Walker | 252 | 95 |
| 4,579,678 | 04/01/86 | Walker | 252 | 95 |
| 4,601,845 | 07/22/86 | Namnath | 252 | 99 |
| 4,623,357 | 11/18/86 | Urban | 8 | 107 |
| 4,626,373 | 12/02/86 | Finch et al. | 252 | 96 |
| 4,626,374 | 12/02/86 | Finch et al. | 252 | 174.13 |
| 4,634,551 | 01/06/87 | Burns et al. | 252 | 102 |
| 4,655,782 | 04/07/87 | McCallion et al. | 8 | 111 |
| 3,532,634 | 10/06/70 | Woods | 252 | 95 |
| 4,088,595 | 05/09/78 | Michelson et al. | 252 | 95 |

UNITED STATES PATENT AND TRADEMARK OFFICE

CERTIFICATE OF CORRECTION

PATENT NO. : 5,804,542

DATED : September 8, 1998

INVENTOR(S) : William Micahel Scheper, et al.

It is certified that error appears in the above-identified patent and that said Letters Patent is hereby corrected as shown below:

| DOCUMENT NUMBER | DATE | NAME | CLASS | SUB CLASS |
|---|---|---|---|---|
| 4,655,953 | 04/0787 | Oakes | 252 | 99 |
| 4,711,748 | 12/08/87 | Irwin et al. | 264 | 117 |
| 4,728,455 | 03/01/88 | Rerek | 252 | 99 |
| 4,786,421 | 11/22/88 | Butterworth et al. | 252 | 8.8 |
| 4,810,410 | 03/07/89 | Diakun et al. | 252 | 102 |
| 4,892,555 | 01/09/90 | Leigh et al. | 8 | 101 |
| 4,966,723 | 10/30/90 | Hodge et al. | 252 | 102 |
| 5,002,682 | 03/26/91 | Bragg et al. | 252 | 99 |
| 5,021,187 | 06/04/91 | Harriott et al. | 252 | 186.38 |
| 5,114,606 | 05/19/92 | van Vliet et al. | 252 | 103 |
| 5,114,611 | 05/19/92 | Van Kralingen et al. | 252 | 186.33 |
| 5,153,161 | 10/06/92 | Kerschner et al. | 502 | 167 |
| 5,194,416 | 03/16/93 | Jureller et al. | 502 | 167 |
| 5,200,236 | 04/06/93 | Lang et al. | 427 | 213 |
| 5,227,084 | 07/13/93 | Martens et al. | 252 | 95 |
| 5,244,594 | 09/14/93 | Favre et al. | 252 | 186.33 |
| 5,246,612 | 09/21/93 | Van Dijk et al. | 252 | 102 |
| 5,246,621 | 09/21/93 | Favre et al. | 252 | 186.33 |
| 5,256,779 | 10/26/93 | Kerschner et al. | 540 | 465 |
| 5,274,147 | 12/28/93 | Kerschner et al. | 556 | 45 |
| 5,280,117 | 01/18/94 | Kerschner et al. | 540 | 465 |
| 5,284,944 | 02/08/94 | Madison et al. | 540 | 474 |
| 5,294,365 | 03/15/94 | Welch et al. | 252 | 174.21 |

| Application No. | Inventors | Filing Date |
|---|---|---|
| 08/224,215 | Burns et al. | 04/07/94 |
| 08/224,385 | Baillely et al. | 04/07/94 |
| 08/224,614 | Baillely et al. | 04/07/94 |
| 08/224,617 | Scialla et al. | 04/07/94 |
| 08/295,367 | Hartshorn et al. | 08/24/94 |
| 08/382,546 | Goldstein et al. | 02/02/95 |
| 08/382,750 | Getty et al. | 02/02/95 |

UNITED STATES PATENT AND TRADEMARK OFFICE

CERTIFICATE OF CORRECTION

PATENT NO. : 5,804,542

DATED : September 8, 1998

INVENTOR(S) : William Micahel Scheper, et al.

It is certified that error appears in the above-identified patent and that said Letters Patent is hereby corrected as shown below:

FOREIGN PATENT DOCUMENTS

| DOCUMENT NUMBER | DATE | COUNTRY | CLASS | SUB CLASS | TRANSLATION YES | TRANSLATION NO |
|---|---|---|---|---|---|---|
| DE 2,054,019 | 10/07/71 | Germany | C11D | 7/42 | X | |
| EP 143,491 | 06/05/85 | Europe | C11D | 3/39 | ✓ | |
| EP 224,952 | 06/10/87 | Europe | C11D | 3/39 | ✓ | |
| EP 306,089 | 03/08/89 | Europe | C11D | 3/395 | ✓ | |
| EP 384,503 | 08/29/90 | Europe | C11D | 3/395 | ✓ | |
| EP 408,131 | 01/16/91 | Europe | C11D | 3/39 | ✓ | |
| EP 458,398 | 11/27/91 | Europe | C11D | 3/395 | ✓ | |
| EP 544,440 | 06/02/93 | Europe | C11D | 3/39 | ✓ | |
| EP 544,490 | 06/02/93 | Europe | C11D | 3/39 | ✓ | |
| EP 549,271 | 06/30/93 | Europe | C11D | 3/39 | ✓ | |
| EP 549,272 | 06/30/93 | Europe | C11D | 3/39 | ✓ | |
| GB 2149418 | 06/12/85 | Great Britain | C11D | 3/60 | ✓ | |
| WO 94/23637 | 10/27/94 | World | A47L | 15/00 | ✓ | |
| EP 677,576 | 10/18/95 | Europe | C11D | 3/39 | ✓ | |

UNITED STATES PATENT AND TRADEMARK OFFICE

CERTIFICATE OF CORRECTION

PATENT NO. : 5,804,542

DATED : September 8, 1998

INVENTOR(S) : William Michael Scheper et al.

It is certified that error appears in the above-identified patent and that said Letters Patent is hereby corrected as shown below:

Column 28, line 39, "S" should be –5–.

Signed and Sealed this

Twenty-second Day of February, 2000

*Attest:*

Q. TODD DICKINSON

*Attesting Officer*

*Commissioner of Patents and Trademarks*